US012318648B2

(12) United States Patent
Tarkington et al.

(10) Patent No.: US 12,318,648 B2
(45) Date of Patent: Jun. 3, 2025

(54) RESISTANCE BAND SYSTEM

(71) Applicant: TS Medical, LLC, McLean, VA (US)

(72) Inventors: Mary Anne Tarkington, McLean, VA (US); Donald C. Meves, Gahanna, OH (US); Chris W. Cicenas, Whitehall, OH (US); David G. Boulos, Norton, MA (US); Hans J. Schmidt, McLean, VA (US)

(73) Assignee: TS Medical, LLC, McLean, VA (US)

( * ) Notice: Subject to any disclaimer, the term of this patent is extended or adjusted under 35 U.S.C. 154(b) by 193 days.

(21) Appl. No.: 18/224,371

(22) Filed: Jul. 20, 2023

(65) Prior Publication Data

US 2024/0024726 A1 Jan. 25, 2024

Related U.S. Application Data

(60) Provisional application No. 63/368,917, filed on Jul. 20, 2022.

(51) Int. Cl.
*A63B 21/055* (2006.01)

(52) U.S. Cl.
CPC ..... *A63B 21/0555* (2013.01)

(58) Field of Classification Search
CPC ..... A63B 21/00058; A63B 21/00061; A63B 21/00065; A63B 21/002; A63B 21/0023; A63B 21/04; A63B 21/0407; A63B 21/0414; A63B 21/0421; A63B 21/0428; A63B 21/0435; A63B 21/0442; A63B 21/055; A63B 21/0552; A63B 21/0555; A63B 21/0557; A63B 21/4027; A63B 21/4033; A63B 21/4034; A63B 21/4035; A63B 22/16; A63B 23/0238; A63B 23/0405; A63B 23/08; A63B 23/085;
(Continued)

(56) References Cited

U.S. PATENT DOCUMENTS 3,345,067 A * 10/1967 Smith ..... A63B 21/04 482/121
3,838,852 A * 10/1974 Gury ..... A63B 21/0552 482/125

(Continued)

FOREIGN PATENT DOCUMENTS

WO 2016123135 A1 8/2016

OTHER PUBLICATIONS

Amazon Soloflex Replacement Band, available for sale since Sep. 28, 2020 (https://www.amazon.com/Yaphy-Technology-Soloflex-Replacement-Muscle/dp/B08akBYV97M/ (Year: 2020).*

*Primary Examiner* — Gary D Urbiel Goldner
(74) *Attorney, Agent, or Firm* — Greenberg Traurig, LLP; David J. Dykeman; Joshua I. Rudawitz

(57) ABSTRACT

A resistance band and bridle system are disclosed. The resistance band can include a barbell shaped band having a central body extending along a central length, the central body including at least one loop at an end of the barbell shaped band; and at least one bushing disposed within the at least one loop, the at least one bushing formed of a low friction material. The at least one loop can be configured to stretch and/or deform relative to the at least one bushing and the at least one loop configured to axially secure the at least one bushing within the at least one loop.

18 Claims, 15 Drawing Sheets

(58) Field of Classification Search
CPC . A63B 23/10; A63B 23/1245; A63B 23/1281; A63B 23/14; A63B 26/00; A63B 26/003; A63B 71/0054; A63B 2071/0063; A63B 2071/0072; A63B 2071/0694; A63B 2209/00; A63B 2209/02; A63B 2225/09
See application file for complete search history.

(56) References Cited

U.S. PATENT DOCUMENTS 3,912,266 A * 10/1975 Gury ..... A63B 21/0552 273/159
4,492,375 A * 1/1985 Connelly ..... A63B 21/055 482/130
D280,224 S * 8/1985 Wilson ..... 482/129
4,582,320 A * 4/1986 Shaw ..... A63B 21/4035 482/130
D315,936 S * 4/1991 Wilson ..... 482/129
5,039,092 A * 8/1991 Olschansky ..... A63B 21/4047 482/130
5,046,199 A * 9/1991 Hall ..... G02C 5/02 2/446
5,135,216 A * 8/1992 Bingham ..... A63B 21/05 482/52
5,242,353 A * 9/1993 Cole ..... A63B 21/04 482/130
5,277,684 A * 1/1994 Harris ..... A63B 23/03533 482/121
5,334,122 A * 8/1994 Cole ..... A63B 21/04 482/121
5,800,323 A * 9/1998 Ansel ..... A63B 21/169 482/904
5,976,063 A 11/1999 Joutras et al.
6,053,816 A * 4/2000 Immel ..... F16F 3/12 472/105
6,254,517 B1 * 7/2001 Kennedy ..... A63B 21/0552 482/121
6,817,967 B1 * 11/2004 Ott ..... A63B 21/4019 482/47
11,766,587 B1 9/2023 Fischer
2004/0152569 A1 * 8/2004 Lerner ..... A63B 21/4015 482/124
2006/0063652 A1 * 3/2006 Berman ..... A63B 21/153 482/126
2010/0311552 A1 12/2010 Sumners et al.
2010/0331603 A1 12/2010 Szecsi
2014/0113773 A1 * 4/2014 Marghella ..... A63B 21/4007 482/130
2016/0074691 A1 * 3/2016 Pearce ..... A63B 23/1236 482/121
2016/0129294 A1 * 5/2016 Gillespie ..... A63B 71/0054 482/124
2016/0213924 A1 * 7/2016 Coleman ..... A61N 1/0484
2017/0144009 A1 * 5/2017 Pearce ..... A63B 21/0004
2019/0160322 A1 * 5/2019 McCarthy ..... A63B 21/4034
2019/0308051 A1 * 10/2019 D'Alesio ..... A63B 21/00043
2020/0086172 A1 * 3/2020 Tarkington ..... A63B 21/022
2021/0393474 A1 12/2021 Hernan
2022/0152451 A1 5/2022 Shawl

* cited by examiner

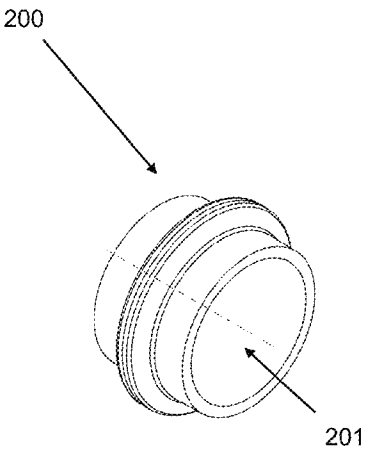
FIG. 4A
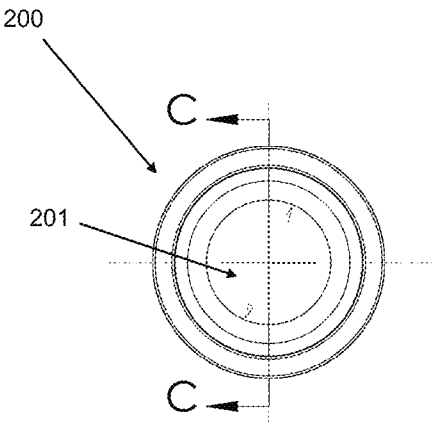
FIG. 4B
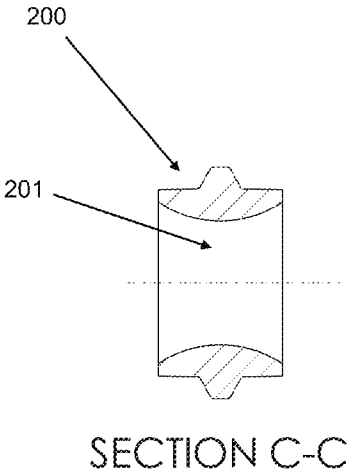
FIG. 4C
FIG. 4D

SECTION B-B

SECTION C-C

RESISTANCE BAND SYSTEM

CROSS-REFERENCE TO RELATED APPLICATIONS

This application claims the benefit of U.S. Provisional Application No. 63/368,917, filed Jul. 20, 2022, entitled RESISTANCE BAND SYSTEM, hereby incorporated by reference in its entirety.

FIELD

The present disclosure is generally related to resistance bands, and more particularly related to a self-aligning resistance band system.

BACKGROUND

Prior art exercise equipment relies upon a variety of resistance mechanisms to provide feedback and strength training for patients, or those seeking better physical fitness. Traditionally, one such resistance mechanism can be weights, which rely upon gravity to create resistive forces. Additionally, there are other mechanisms including those that rely upon spring forces to create resistive forces. However, prior art mechanisms, such as resistance bands, tangle, or kink, causing problems, such as: (1) preventing the exercise device from functioning properly; and (2) focusing undue stress on particular areas of the equipment, causing the band to break.

It is evident that manufacturers of exercise equipment (as well as medical, orthodontic, industrial, etc. equipment) have grappled with this same issue of kinking, tangling and focused strain on the point of connection between an elastomeric band and support portions of the device. Most address the aforementioned issues by affixing metal connectors to the band and the support either directly or via a transition piece made of an alternative material. None of these strategies seen in the art functioned sufficiently to overcome the aforementioned deficiencies in the art with respect to exercise devices.

SUMMARY

In an embodiment a resistance band is disclosed. The resistance band includes a barbell shaped band having a central body extending along a central length, the central body including at least one loop at an end of the barbell shaped band; and at least one bushing axially secured within the at least one loop, the at least one bushing formed of a low friction material, wherein the at least one bushing is able to translate relative to the loop.

In some embodiments, the barbell shaped band can be a unitary structure. The barbell shaped band can be formed of thermoplastic elastomer. The barbell shaped band can include at least two loops, respectively disposed at the ends of the barbell shaped band. The at least one bushing can be at least two bushings, and each of the at least two bushings can be disposed in a respective one of the at least two loops. The at least one bushing can be a substantially cylindrical shaped bushing or a teardrop shaped bushing. The at least one bushing can include a through hole extending therethrough. The at least one bushing can include a reinforcement rib that extends radially outward from an outer surface of the at least one bushing. The at least one bushing can be retained within the at least one loop without adhesives or chemical bonding. The resistance band can be manufactured via overmolding or separately molding the band and assembling the bushing into the band. The low friction material can be DELRIN.

In some embodiments, a bridle system is disclosed herein. The bridle system includes an upper platform including at least one upper hook extending from a first surface thereof; a lower support structure pivotally connected to the upper platform, the lower support structure including at least one lower hook extending from a second surface thereof, the first surface and the second surface face one another; and a resistance band, the resistance band including a central body extending along a central length, the central body including a first loop at a first end of the central body and a second loop at a second end of the central body; and a first bushing axially secured within the first loop and a second bushing axially secured within the second loop, the first bushing and the second bushing formed of a low friction material, wherein the first loop is disposed on the at least one upper hook and the second loop is disposed on the at least one lower hook, wherein the first bushing is able to translate relative to the first loop, and wherein the second bushing is able to translate relative to the second loop.

In some embodiments, the central body can be a barbell shaped band. The barbell shaped band can be a unitary structure. The barbell shaped band can be formed of thermoplastic elastomer. The first bushing and the second bushing can be substantially cylindrical shaped bushings or teardrop shaped bushing. The first bushing and the second bushing can each include a reinforcement rib that extends radially outward from an outer surface of the respective first bushing and second bushing. The first bushing can be retained within the first loop without adhesives or chemical bonding, and the second bushing can be retained within the second loop without adhesives or chemical bonding. The resistance band can be manufactured via overmolding or separately molding the band and assembling the bushing into the band. The low friction material can be DELRIN. The at least one upper hook and the at least one lower hook can be formed of glass-filled nylon. The resistance band can be a resistance spring.

BRIEF DESCRIPTION OF THE DRAWINGS

The accompanying drawings illustrate various embodiments of systems, methods, and embodiments of various other aspects of the disclosure. Any person with ordinary skills in the art will appreciate that the illustrated element boundaries (e.g., boxes, groups of boxes, or other shapes) in the figures represent one example of the boundaries. It may be that in some examples one element may be designed as multiple elements or that multiple elements may be designed as one element. In some examples, an element shown as an internal component of one element may be implemented as an external component in another, and vice versa. Furthermore, elements may not be drawn to scale. Non-limiting and non-exhaustive descriptions are described with reference to the following drawings. The components in the figures are not necessarily to scale, emphasis instead being placed upon illustrating principles.

FIG. 4A, FIG. 4B, FIG. 4C, and FIG. 4D illustrate various views of a resistance band bushing according to an embodiment;

DETAILED DESCRIPTION

Figures 1A, 1B, 1C, 1D, 1E:
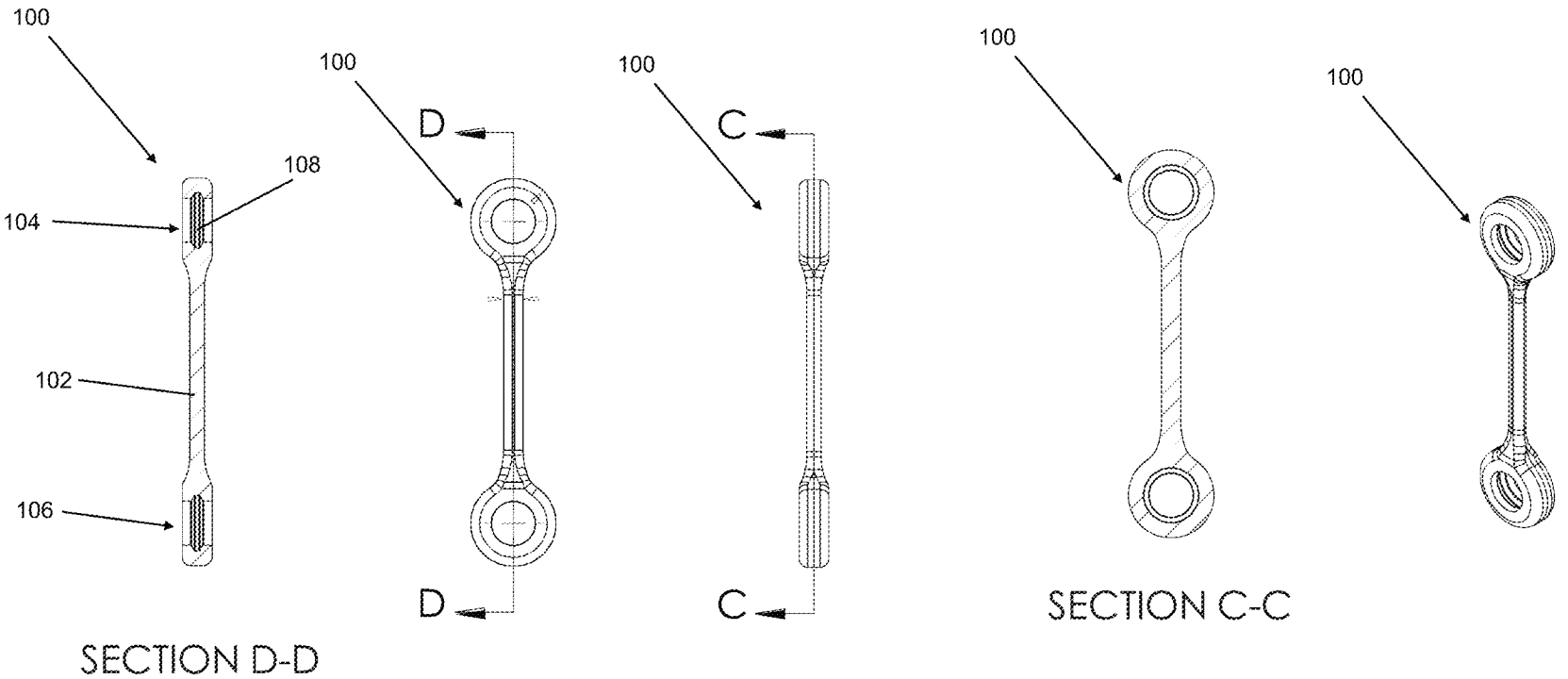
FIG. 1A, FIG. 1B, FIG. 1C, FIG. 1D and FIG. 1E illustrates various views of a resistance band according to an embodiment.
Figure 2A:
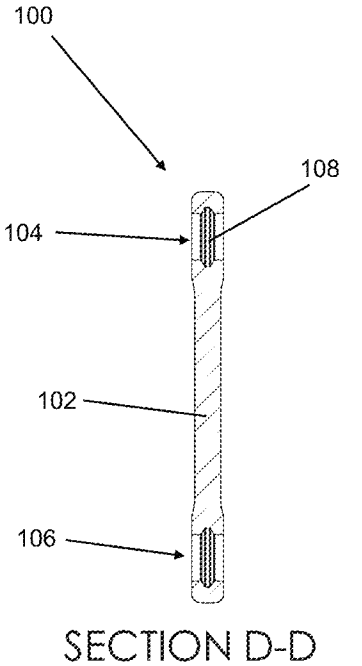
FIG. 2A, FIG. 2B, FIG. 2C, FIG. 2D and FIG. 2E illustrate various views of a resistance band according to an embodiment.
Figure 2B:
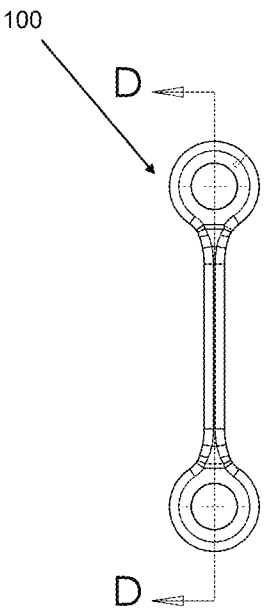
Figure 2C:
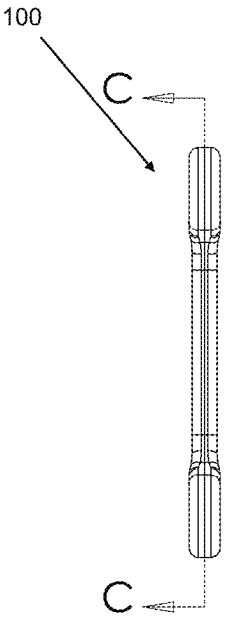
Figure 2D:
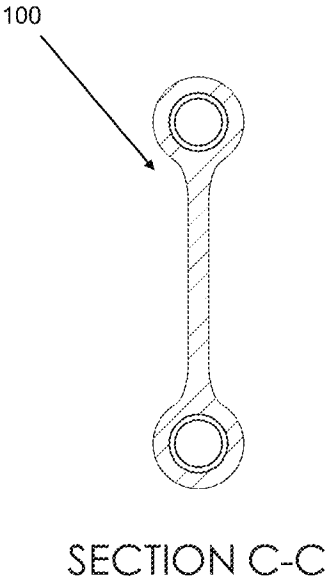
Figure 2E:
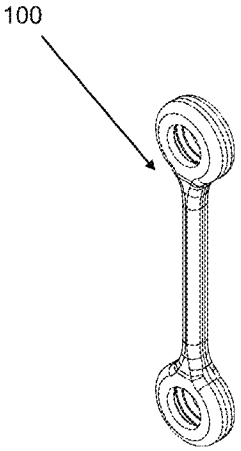
Figure 3A:
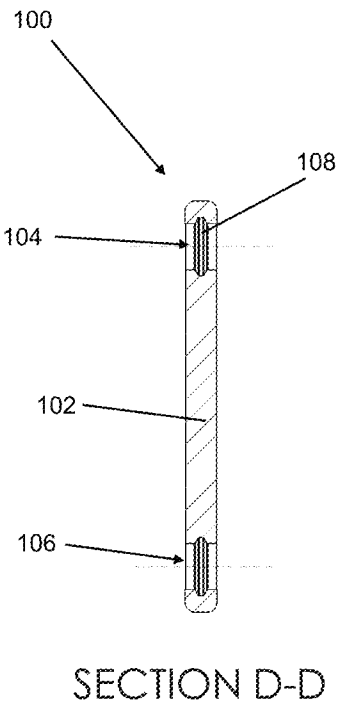
FIG. 3A, FIG. 3B, FIG. 3C, FIG. 3D and FIG. 3E illustrate various views of a resistance band according to an embodiment.
Figure 3B:
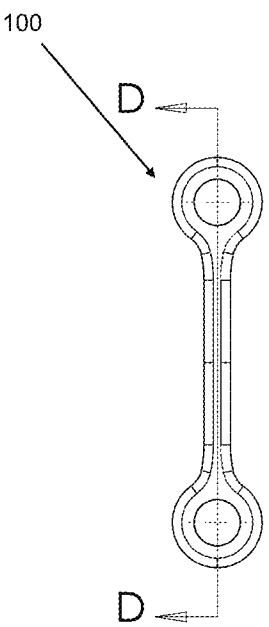
Figure 3C:
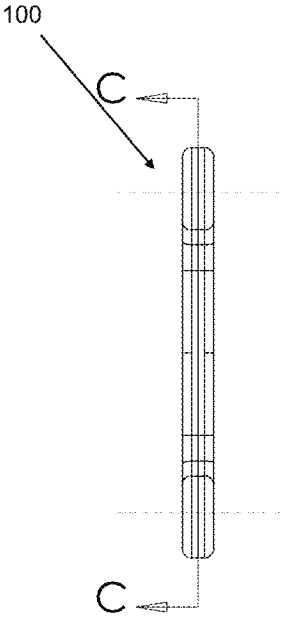
Figure 3D:
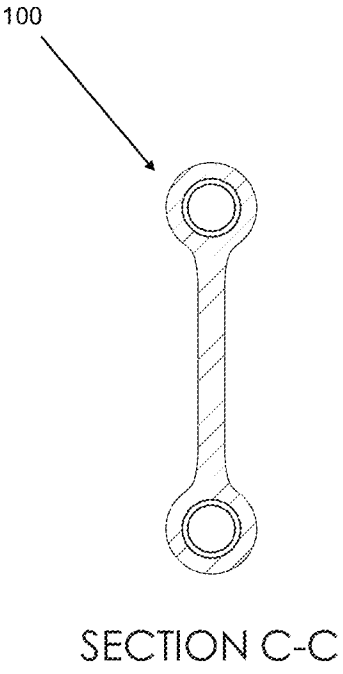
Figure 3E:
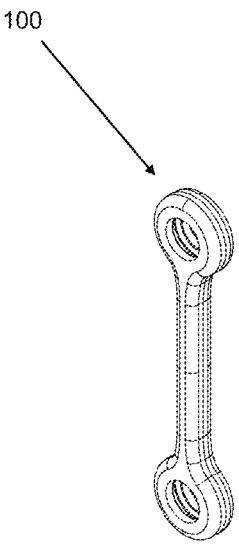

Some embodiments of this disclosure, illustrating all its features, will now be discussed in detail. The words "comprising," "having," "containing," and "including," and other forms thereof, are intended to be equivalent in meaning and be open ended in that an item or items following any one of these words is not meant to be an exhaustive listing of such item or items or meant to be limited to only the listed item or items.

It must also be noted that as used herein and in the appended claims, the singular forms "a," "an," and "the" include plural references unless the context clearly dictates otherwise. Although any systems and methods similar or equivalent to those described herein can be used in the practice or testing of embodiments of the present disclosure, the preferred systems and methods are now described.

As used herein, the term "band" can mean an elastomeric cord that connects two anchor points. As used herein, the term "body" can mean the central length of the band, between the two ends. As used herein, the term "bridle" can refer to the construct that allows the loop of the band to translate, about a bushing with minimal, to no friction, as the latter is affixed to an anchor point. As used herein, the term "translate," or "translation," can include all relative motion, including, but not limited to rotation, pivoting, or linear motion, unless otherwise specified. As used herein, the term "bushing" can refer to a ring which surrounds an aperture within a loop; the bushing can interface with the anchor points. As used herein, the term "end" can mean the lengthwise termini of the device. As used herein, the term "loop" can mean an aperture in the end of the band, through which an anchor can be engaged.

Embodiments of the present disclosure will be described more fully hereinafter with reference to the accompanying drawings in which like numerals represent like elements throughout the several figures, and in which example embodiments are shown. Embodiments of the claims may, however, be embodied in many different forms and should not be construed as limited to the embodiments set forth herein. The examples set forth herein are non-limiting examples and are merely examples among other possible examples.

The instant resistance devices, disclosed herein, are designed such that the resistance devices can continuously reposition themselves, at the points of attachments, during use so as to minimize stress at a joint between the resistance device and a device. One value of such a resistance device can be to distribute forces as evenly as possible, so that there will not be excessive stress on one portion of each resistance device, which can create an early failure point.

The instant disclosure is related to a band system that can include a bridle construct in either end of an elastomeric band. The bridle, or bushing, can allow continuous self-alignment of the elastomeric band with the direction of forces applied to it by virtue of the rotation in the bridle and its ability to readily slide over attachment hooks on the device, itself. Bridle constructs can allow different materials of the bridle construct to self-align so as to minimize forces continuously, even as those materials are moving in opposing directions. Such a design can have applications in many areas including headgear for horses, tethering ships, coordinating components of drilling equipment, fastening shoes, and aligning components of medical devices for orthodontic applications or suspension of internal organs, in which there is frequent movement.

In one embodiment, the bridle construct can have utility in enhancing the longevity and safety of exercise equipment, or other devices, containing elastomeric resistance bands. Such equipment is often challenged by the dynamics of forces moving between resistance bands and supporting components of the device, with which the bands connect. Friction at the joint between the band and the support structures can cause the band to tangle or kink, focusing large amounts of force in a small area of the resistance band during operation. Repeated focal forces can cause the band to wear or fracture rapidly. Existing resistance bands cannot achieve a full bridling effect and the resistance band is unable to effectively enable self-alignment of the resistance band itself. The present disclosure utilizes a novel combination of materials within the resistance band to achieve a lower friction bridle construct. In an embodiment, the lower friction bridle construct can have a coefficient of friction in the range of 0.02-0.04. For example, DELRIN (acetal homopolymer) which has low coefficient of friction can be utilized to enhance the longevity of the resistance band.

As shown in FIGS. 1A-10D, the resistance band system 300 according to various embodiments are shown. The resistance band system 300 can include a band 100 which can generally be any spring including but not limited to bungee cords, metal coils, pneumatic piston systems, hydraulic piston systems, or other elastic systems or devices. In an embodiment, the band may have a solid body 102 portion with two ends 104, 106, or termini, on either end of the body portion 102. Such a configuration can be referred to as a barbell shape. The body portion 102 can have a roughly rectangular cross section, having dimensions that vary with the amount of resistance they provide. For example, as illustrated in FIGS. 1A-3E, resistance band can provide 3 lbs (FIGS. 1A-1E), 6 lbs (FIGS. 2A-2E), or 9 lbs (FIGS. 3A-3E) of resistance based upon the thickness of the respective body portions 102. Alternatively, other resistance levels are contemplated to be within the scope of this disclosure, including, but not limited to, resistance levels from 1 lb to 100 lb depending on the needs of the user. The varied resistance levels can be modified by the user by replacing the respective resistance bands 100 on the device 300. In the case of a 3 lb. resistance band, the body portion can have a thickness of approximately 0.120 inches. In the case of a 6 lb. resistance band, the body portion can have a thickness of approximately 0.200 inches. In the case of a 9 lb. resistance band, the body portion can have a thickness of approximately 0.250 inches.

As noted previously, the body portion 102 can include two ends 104, 106 on the distal and proximal ends of the body portion 102. The ends can be loops that are generally round. In one embodiment, the loops can have the dimensions of 0.724" outer diameter and can be 0.250" thick. These dimensions are provided for example only and are not intended to be limiting. The band can be formed as a unitary structure that is formed from any elastomer material, such as thermoplastic elastomer (TPE). In some embodiments the band can be formed from any one, or combination of, silicone-liquid or molded, rubber, TPE, latex, TPV, Santoprene, bungee cords, medical grade elastomeric tubing, or other elastic or plastic materials. The band can be formed via overmolding, as will be discussed below. Due to the overmolding process, the loops can be imparted with a generally V-shaped groove 108, as seen in at least FIG. 1A, FIG. 2A, and FIG. 3A. Such a groove 108 can retain a bushing 200 disposed within the respective loop, to prevent the bushing 200 from moving axially within the loop.

Figure 5:
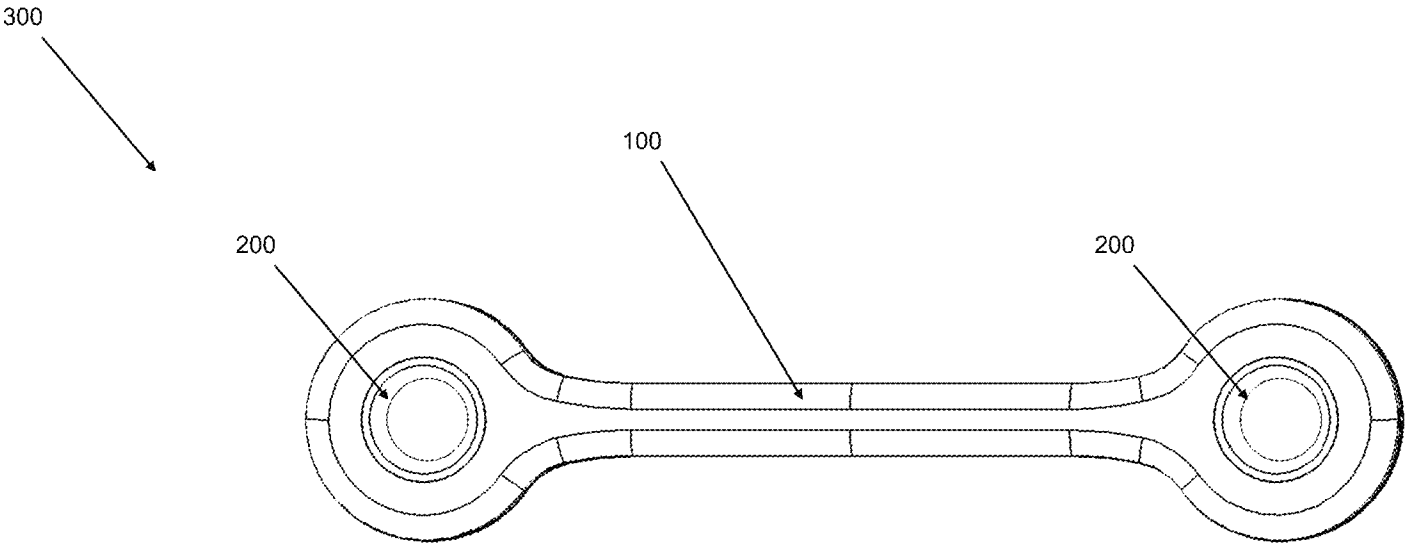
FIG. 5 illustrates a resistance band assembly according to an embodiment of the present disclosure.

As shown in FIG. 4A, FIG. 4B, FIG. 4C, and FIG. 4D, a bushing 200 can be provided. In an embodiment, the bushing 200 can have a substantially cylindrical shape having a through hole 201 extending therethrough. In an embodiment, the bushing 200 can be made of DELRIN, though other low friction materials may be used. In an embodiment, the bushing 200 can seat securely within the groove 108 of the band 100, as seen in FIG. 5, to form the resistance band system 300. The bushing 200 can include an outward radially extending ring 202 which can be complimentary to the V-shaped groove 108, though other shapes are considered to be within the scope of this disclosure. While the bushing 200 is axially retained within the loop, the bushing 200 is able to rotate about the central axis A while within the groove. In some embodiments, the loop 104, 106 can stretch, or elongate such that the bushing 200 is able to translate, e.g., linearly, relative to the loop in a direction that is perpendicular to the central axis A. The translation of the bushing 200 within a respective loop 104, 106 can allow for optimization of the performance of the exercise device that the bands are being used with. For example, without the bushing, the bands may tangle or kink about a hook 402 or other securement. Bands without the bushings 200 of the instant disclosure may lead to problems such as: (1) preventing the device from functioning properly; and (2) focusing undue stress on particular areas of the band in the area of the loop, causing the band to break. The instant band 100 and bushing 200 in combination with the hook 402 can more evenly distribute forces throughout the band to enable smooth, predictable, operation about the hook 402 and can optimize band life.

In an alternative embodiment, as shown in FIGS. 6A, 6B, 6C, and 6D, can provide a resistance band system 300 having tear drop shaped loops and bushings. The body portion 102 can include two ends 104, 106 on the distal and proximal ends of the body portion 102, as shown in FIG. 7A, FIG. 7B, and FIG. 7C. The two ends 104, 106 can be loops that are generally tear drop shaped. For example, the tear drop shaped loops can have a curved end 105*a*, 105*b*, that converge to an apex 107*a*, 107*b*, as shown in FIG. 7A, FIG. 7B, and FIG. 7C. The apex 107*a*, 107*b* can be a point or can have a smaller radius of curvature than the curved ends 105*a*, 105*b*. In an embodiment, the apex 107*a* of the first loop 104 and the apex 107*b* of the second loop 106 can be pointed at each other. In some embodiments, the band 100 can be formed from the same materials as previously discussed bands 100 and, in some embodiments, can have the same or similar dimensions. While not illustrated, the band of FIGS. 6A, 6B, 6C, and 6D can be formed via overmolding, as discussed above, such that the loops 104, 106 can be imparted with a generally V-shaped groove 108, similar to the embodiments as seen in at least FIG. 1A, FIG. 2A, and FIG. 3A. Such a groove 108 can retain a bushing 200 disposed within the respective loop, to prevent the bushing 200 from moving axially within the loop.

Figure 6D:
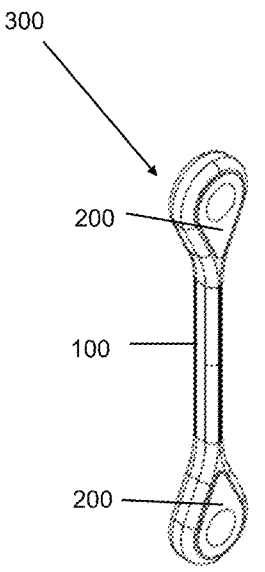
FIG. 6A, FIG. 6B, FIG. 6C, and FIG. 6D illustrate various views of an alternative resistance band system according to an embodiment.
Figure 6C:
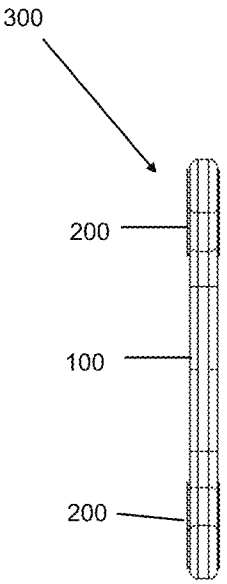
Figure 6B:
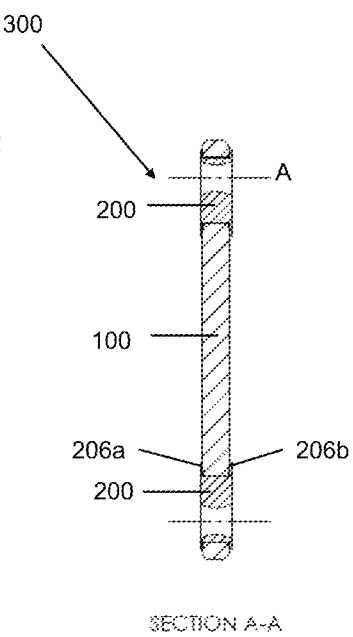
Figure 6A:
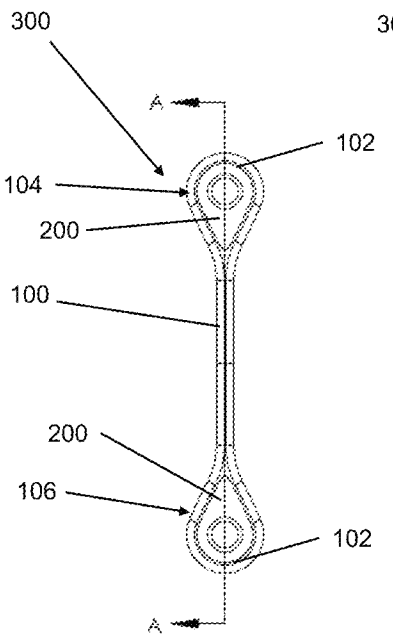
Figure 7C:
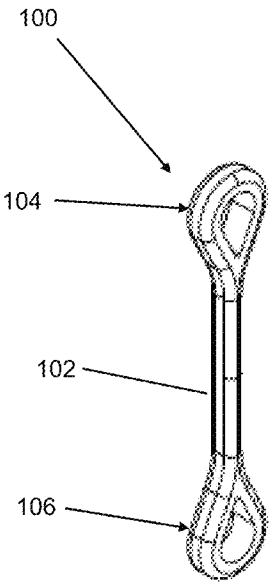
FIG. 7A, FIG. 7B, and FIG. 7C illustrate various views of an alternative resistance band according to an embodiment of the present disclosure.
Figure 7B:
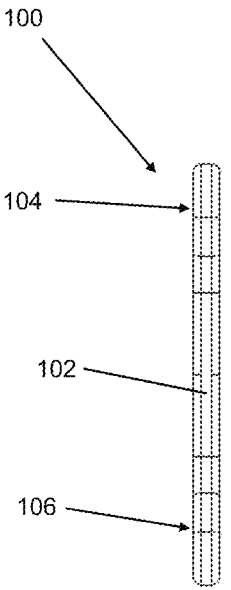
Figure 7A:
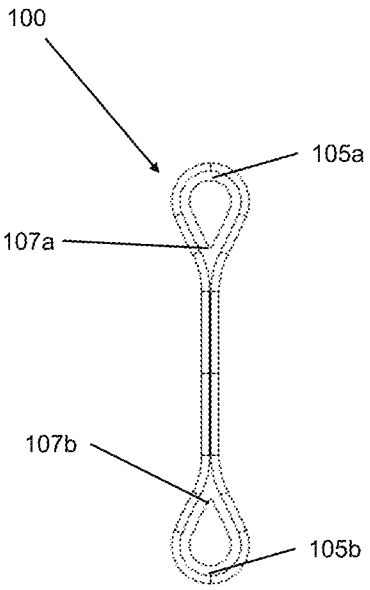
Figure 8D:
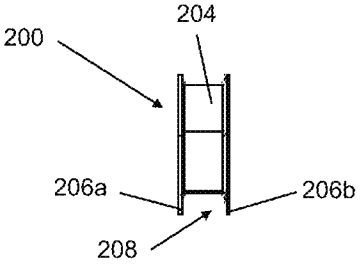
FIG. 8A, FIG. 8B, FIG. 8C, FIG. 8D, and FIG. 8E illustrate various views of an alternative resistance band bushing according to an embodiment.
Figure 8B:
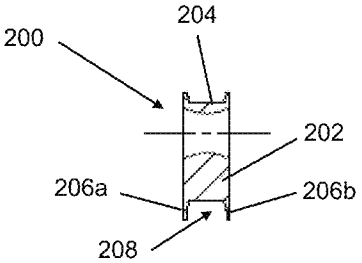
Figure 8E:
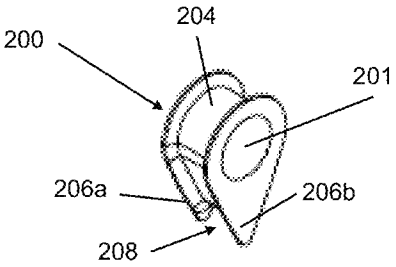
Figure 8A:
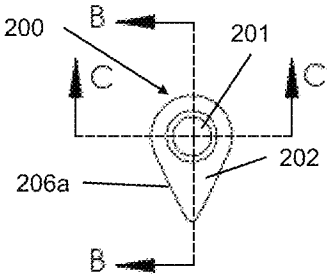
Figure 8C:
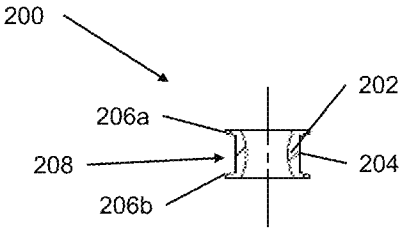

As shown in FIG. 8A, FIG. 8B, FIG. 8C, FIG. 8D, and FIG. 8E, a teardrop shaped bushing 200 can be provided as part of the resistance band system 300 of FIGS. 6A, 6B, 6C, and 6D. In an embodiment, the bushing 200 can be made of DELRIN, though other low friction materials may be used. The bushing 200 can, in an embodiment, include a through hole 201 which can receive a hook 402, as discussed further below. The bushing 200 can include a ring 202 which can be complimentary to the tear drop shape of either of the loops 104, 106, though other shapes are considered to be within the scope of this disclosure. In an embodiment, the bushing 200 can have an exterior surface 204 that extends around the entire bushing 200. The exterior surface 200 can have a first radially extending wall or ridge 206*a* and a second radially extending wall or ridge 206*b* which can define a groove 208. The groove 208 can securely seat the respective loop 104, 106 of the band 100, as seen in FIG. 6B, to form the resistance band system 300. While the bushing 200 is axially retained within the loop 104, 106, the tear drop shaped bushing 200 can be prevented from, or at least resist, rotating about the central axis A while within the groove. However, due to a relatively lower coefficient of friction, as compared to the band 100, the bushing 200 can slide, or glide, over a hook 402 with a lower chance of kinking or tangling. In some embodiments, the loop 104, 106 can stretch, or elongate such that the bushing 200 is able to translate, e.g., linearly, relative to the loop in a direction that is perpendicular to the central axis A. For example, without the bushing 200, the bands can tangle or kink about a hook 402 or other securement. Bands without the bushings 200 of the instant disclosure may lead to problems such as: (1) preventing the device from functioning properly; and (2) focusing undue stress on particular areas of the band in the area of the loop, causing the band to break. The instant band 100 and bushing 200 in combination with the hook 402 can more evenly distribute forces throughout the band to enable smooth, predictable, operation about the hook 402 and can optimize band life.

Generally, the instant resistance band systems 300 can be highly elastic to properly stretch and provide resistance during use, e.g., exercise. For example, the material of the instant band 100 can provide for up to, 300% stretch, or more. In some embodiments, for example in cases of bands 100 having a higher resistance, the band 100 may only stretch about 50%, about 25%, or less. The difference in resistance to stretching in a band can be a function of the material property, e.g., the modulus of elasticity or the geometry of the cross section of the band 100. In some examples, the resistance of the band 100 can increase the more the band 100 is stretched. In some embodiments, this elasticity can cause a material to be "sticky" (adhesive) at times. In order to prevent or reduce the "sticky" nature of certain materials, formulations of TPE can be chosen to meet the particular strength/resistance and elongation required for this use case. Additional considerations in material selection can include good tear resistance and a nice quality feel. The band 100 can be made of other, alternative materials, including natural rubbers such as EPDM and SBR. Such rubber materials may have sufficiently low surface friction properties to not require a bushing 200 in order to move freely about the hook 402.

Similarly, the bushing component 200 can be formed of a material and in a geometry that minimizes adhesion to the band. For example, the bushing 200 can be formed of a smooth, hard, DELRIN with an ultra-thin profile and a reinforcement rib to aid in the minimization of both contact and friction between the bushing 200 and the band 100. In some embodiments, the bushing 200 can be a ball bearing assembly to allow for the loop to rotate about the hook.

The resistance band system 300 including the band 100 and the bushing 200 can be produced using an insert and an overmolding approach, as discussed above. Such an overmolding approach can simplify tooling and potentially reduce production costs. This can also prevent adhesion or chemical bonding between the band and the bushing, affording the band freedom to move away from the bushing and distribute forces when stressed. Alternatively, the bands 100 can be molded separately from the bushings 200 and the bushing 200 can be inserted after the molding of the band 100 is completed.

In one embodiment, the instant resistance bands 100 can be used in conjunction with an exercise device 400. For example, the exercise device 400 can include a set of legs 408*a*, 408*b* and a footplate 404, or upper platform. The footplate 404 can be sized, generally, to receive a user's foot, with or without footwear. In some embodiments, the footplate 404 can have a length extending perpendicular to the pivot axis P in the range of approximately 7.00 in to approximately 13 in. In some embodiments, the footplate 404 can have a width extending parallel to the pivot axis P in the range of approximately 3.00 in to approximately 7 in. For example, the footplate 404 can be dimensioned to be about 13 in by 7 in. In an alternative example, the footplate 404 can be dimensioned to be about 7 in by 3 in. In some embodiments the set of legs 408*a*, 408*b* can have a length of approximately 3 in to approximately 7 in and can have a width of approximately 3 in to approximately 7 in. In some embodiments, the width of the legs 408*a*, 408*b* can be substantially the same dimension as the width of the footplate 404. The exercise device 400 can contain eight hooks 402 that are quarter-circular, e.g., 90 degrees or more in shape and molded into the footplate 404 and the base portion 406. For example, four hooks 402 can extend from a bottom surface of the footplate 404 and four hooks can extend from a top surface of the base portion 406. The hooks 402 can be molded glass-filled nylon. In an embodiment, the hooks 402 can be molded from a nylon resin, e.g., ZYTEL, which can be a 30% glass fiber reinforced, toughened polyamide 6 resin. For example, the nylon resin, or glass-filled nylon, can have, within common manufacturing tolerances, the following material properties: 1) tensile modulus between 5600-9000 MPa; 2) Stress at break between 105-160 MPa; 3) Strain at break between 3.5-7%; 4) Flexural modulus between 5000-7800 MPa; and 5) Poisson's ratio 0.34-0.35. The aforementioned material properties are merely one example, and should not be construed as limiting.

Figure 9A:
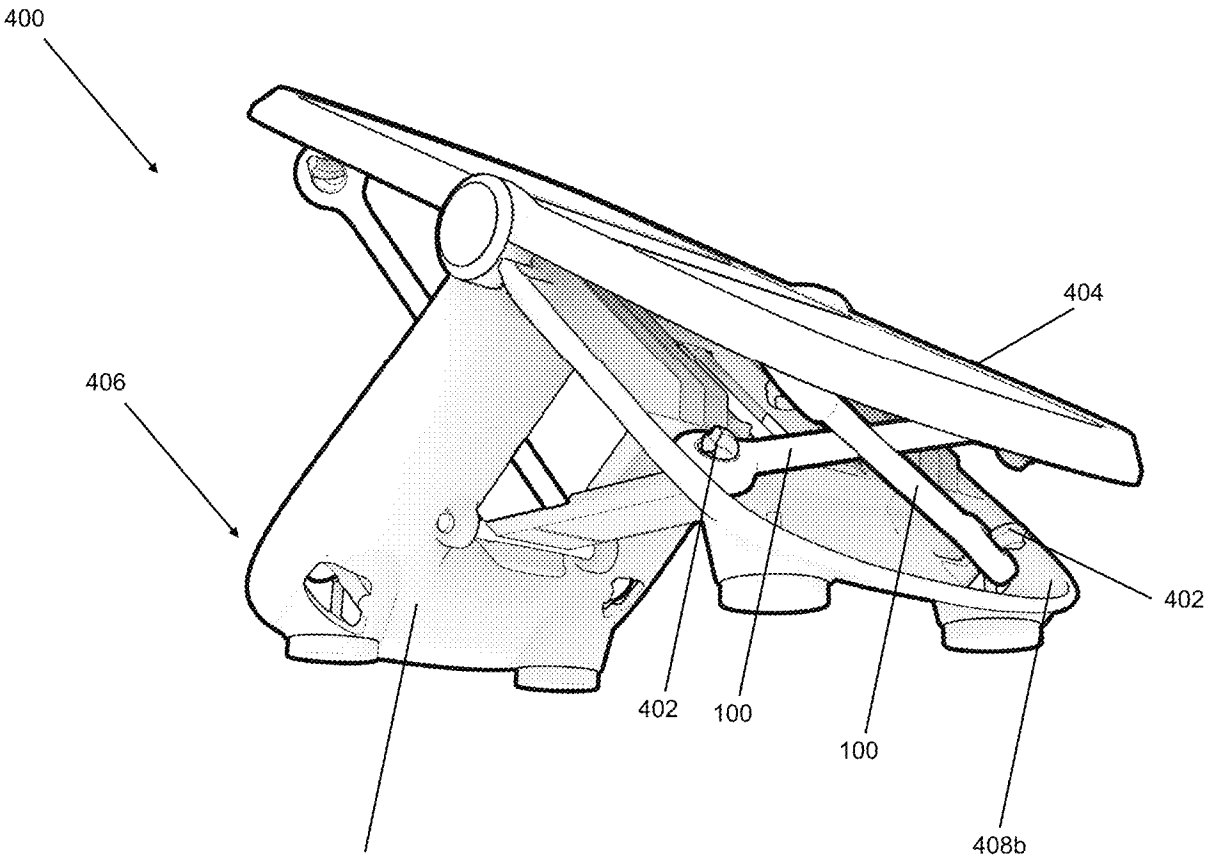
FIG. 9A, FIG. 9B, and FIG. 9C illustrate a system according to an embodiment of the present disclosure.
Figure 9B:
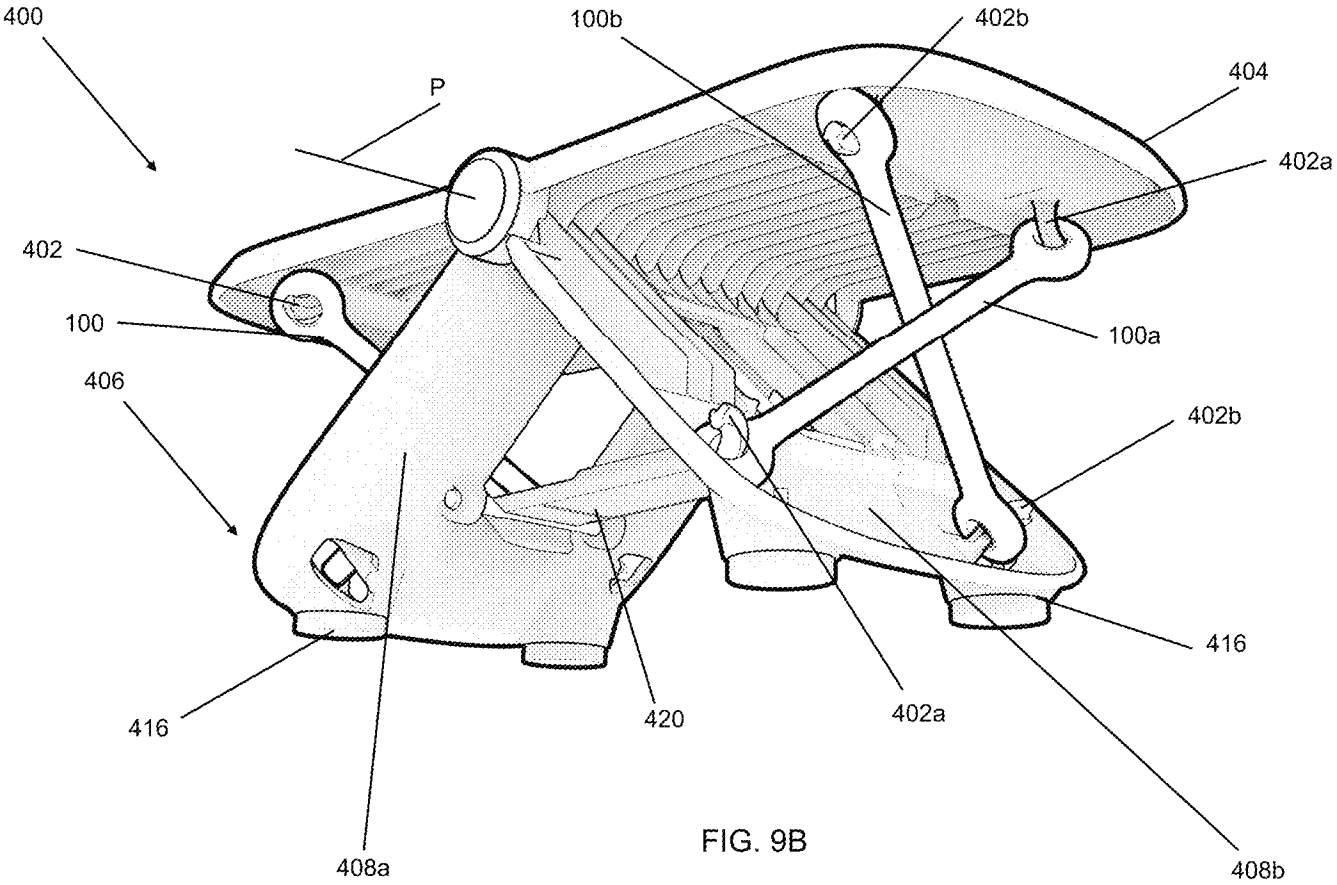
Figure 9C:
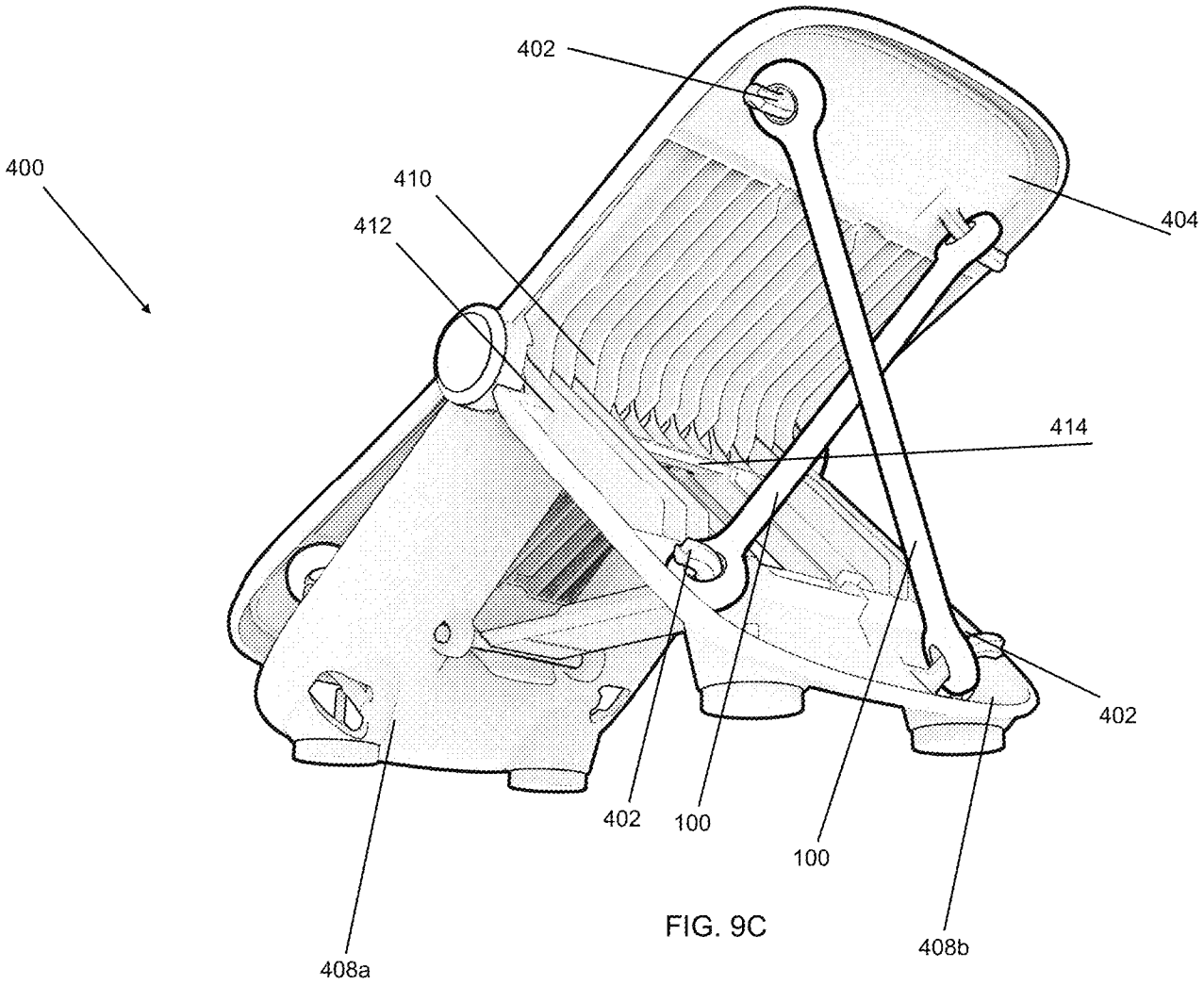
Figure 10A:
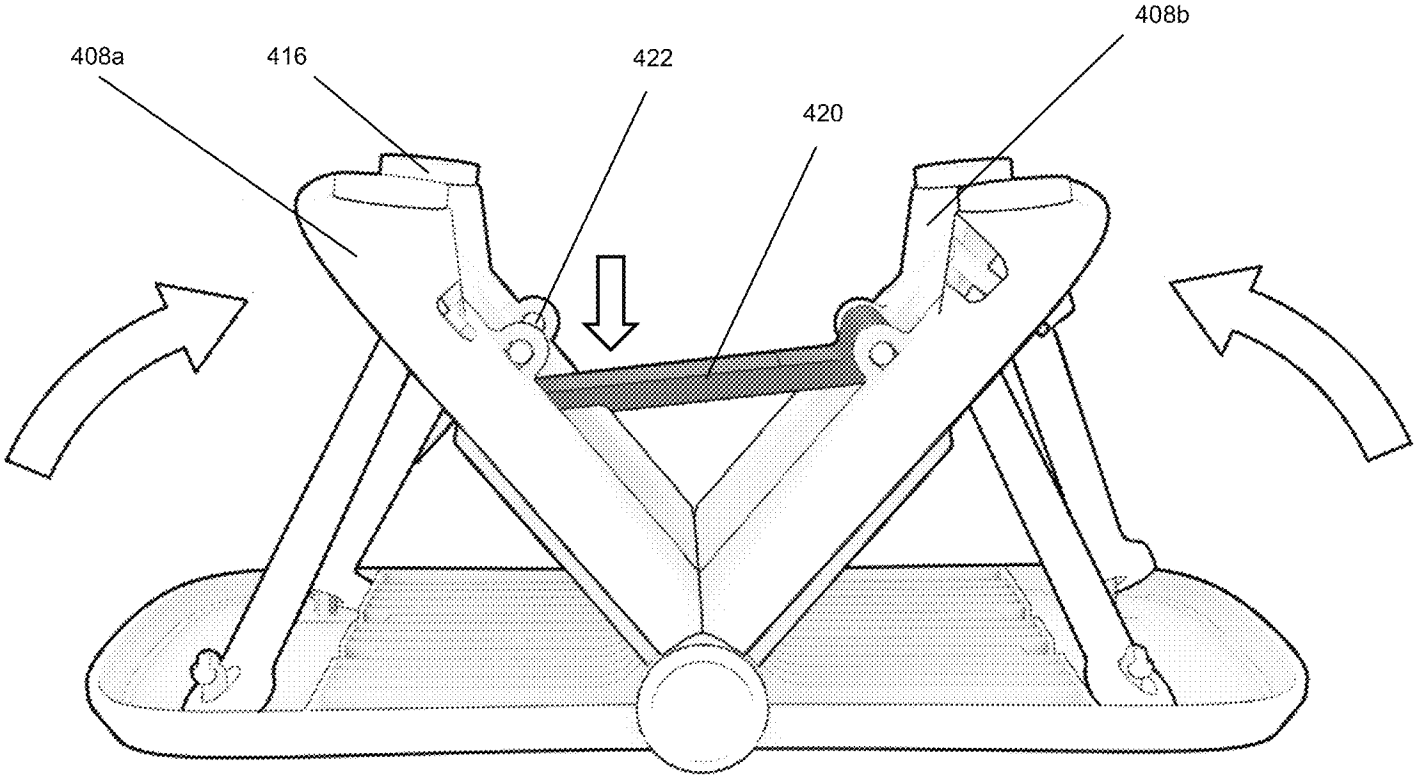
FIG. 10A, FIG. 10B, FIG. 10C, and FIG. 10D illustrate an operation of locking and unlocking the system according to an embodiment of the present disclosure.
Figure 10B:
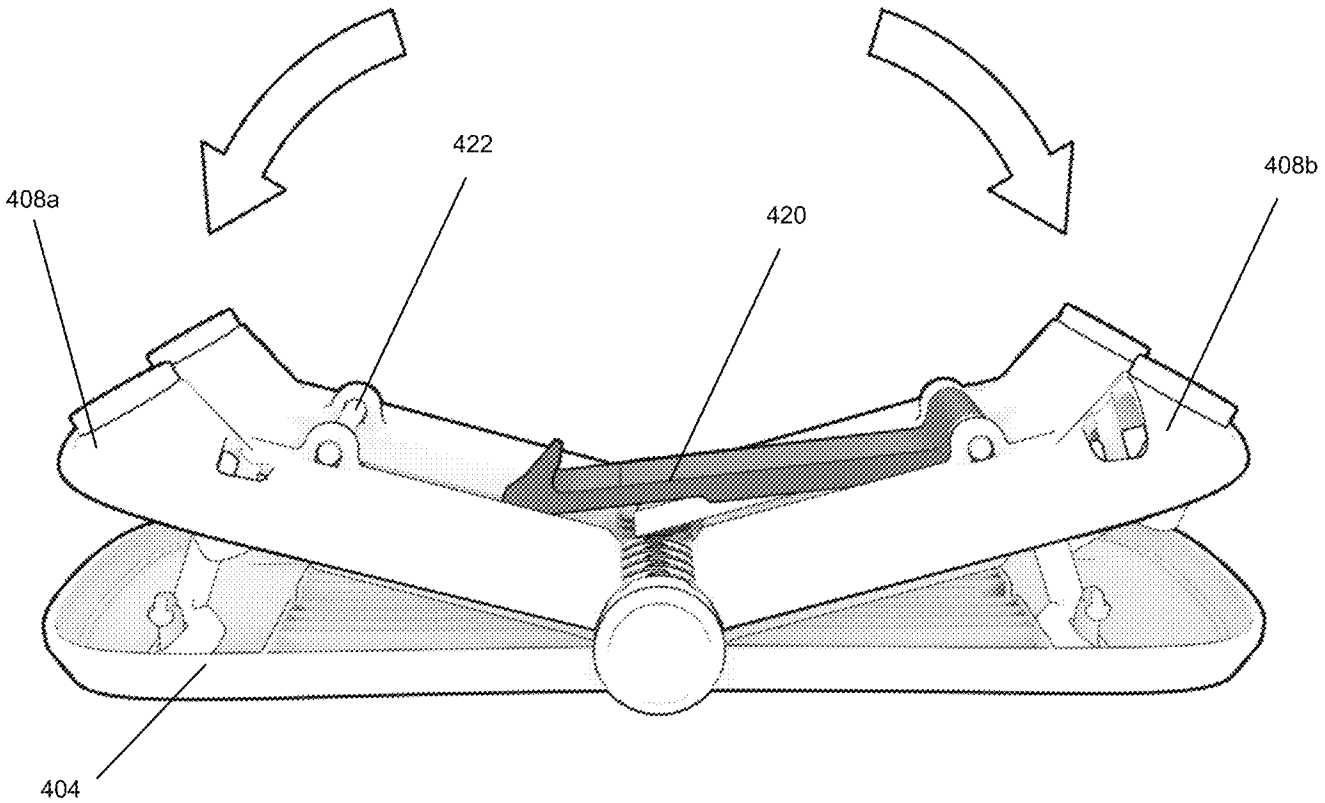
Figure 10C:
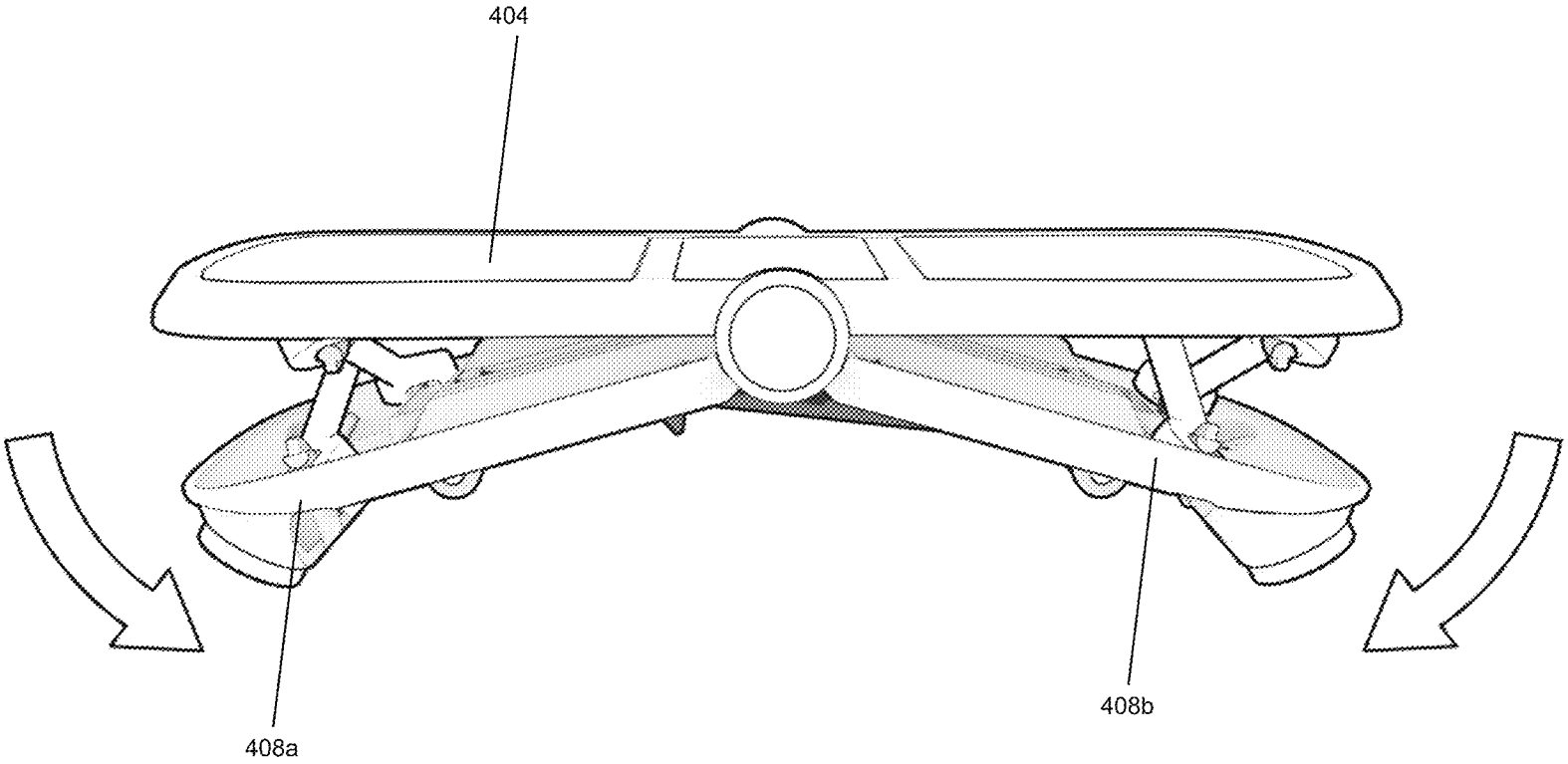

The hooks 402 can be designed to articulate in two planes to maximize distribution of forces throughout the band 100. In the illustrated embodiment of FIG. 9A, FIG. 9B, and FIG. 9C, there can be one hook 402 in each corner of the underside of the footplate 404, e.g., two at the proximal end and two at the distal end, approximately 0.46" from the nearest lateral edge of the footplate and 1.0"–2.0" from the nearest end of the footplate 404. The four remaining hooks 402 can be placed two on each leg 408*a*, 408*b* of the base portion 406, of the exercise device, on a lateral surface approximately 3.84" from the pivot axis and 0.56" from the part edge; the hooks 402 can be offset 0.42". Note, the hooks 402 can be placed in a staggered configuration to prevent contact between bands 100 during use of the exercise device. For example, as seen in FIGS. 9A, 9B, and 9C, a first set of hooks 402*a* connected by a first band 100*a* can be arranged closer to a pivot point P than a second set of hooks 402*b* connected by a second band 100*b*. In addition, the bands 100*a*, 100*b* can be crossed, one over the other. This arrangement of the offset and crossed hooks 402*a*, 402*b* can allow for the bands 100*a*, 100*b* to prevent contact between the bands. In the given device configuration, protection from friction and functionality may be compromised if hook 402 positions shift ⅛", or more. Hook placement and band size can be determined relative to this sizing to achieve the appropriate amount of resistance in the space available. Further, the bands 100*a*, 100*b* can be sized such that they are under tension, or stretched, in all configurations. For example, the bands 100*a*, 100*b* can be under tension when the device 400 is open, ready for use, as seen in FIGS. 9A, 9B, and -9C, and the bands 100*a*, 100*b* can be under tension when the device is collapsed. When the device 400 is collapsed, as seen in FIG. 10C, the tension in the bands 100*a*, 100*b* can retain each leg 408*a*, 408*b* pulled towards the footplate 404, to prevent the device 400 from unexpectedly opening.

At either end of the exercise device 400, one band 100 can be placed on each of the two hooks 402 on the underside of the footplate 404. Each of these bands 100 can then be overextended and its respective loop 104 can be threaded over the contralateral hook on the base at that same, respective, end, as seen in the progression from FIG. 9A to FIG. 9B to FIG. 9C. The tension of the bands 100 can be designed to prevent a band 100 to come off a hook 402 unless it is intentionally overextended, as there is ¾" of "slop" on the hook 402. The term "slop" can generally be understood to mean the clearance, or room, which can allow parts to move relative to one another. For example, the band can move a ¼ inch along the hook without a risk that the band would disengage from the hook.

The bands 100 can be installed in the device 400 such that there is some degree of tension in each of the respective bands 100 at all times, regardless of device 400 configuration. For example, the bands 100 can maintain some degree of tension even when the device 400 is fully collapsed, which is the point when there is the smallest distance between two connected hooks 402 and the band 100 can be at a minimum deformation, or "stretch". When the device 400 is in the collapsed configuration, the tension on the band 100 can help to hold the device closed, bringing the base and the footplate together. The tension in the band 100 can also be sufficient to ensure that the band will not fold over on itself or deviate from its position to interfere with the footplate 404 and/or base portion 406 meeting when the device is collapsed. Threading of each band 100 from the hook 402 on the footplate 404 to the contralateral hook 402 on the base, can guide the band to stow in a position within the collapsed device and can help to draw the footplate 404 and base 406 toward one another. The two bands 100 at each end of the device 400 can cross over one another in low profile securing the collapsed configuration.

As the exercise device is operated, the smooth, hard, convex circular inner surface of the bushing 200 can sweep along the smooth, hard, convex circular surface of the respective hook 402. These two parts can glide with respect one another with minimal friction to help continuously align the band, as seen in FIG. 9A and FIG. 9B. In some embodiments, there may be little, to no friction between the loop 104, 106, and the bushing 200. At the same time, the bushing 200 can rotate within the loop 104, 106 of the band 100 to align the band and transfer stress/force into the body of the band, rather than focusing the stress/force in the loop to allow for dorsi and plantar flexion of the user's foot and therefore the footplate 404 about the pivot point P. Thus, as the resistance band assembly articulates, the band can continuously reorient itself relative to the hook to optimize distribution of forces in the band. While the description of the exercise device 400 is made with reference to a user's foot, it will be appreciated that the pivot motion can be usable for any joint in the body, e.g., the toes, knee, hip, spine, shoulder, elbow, wrist, fingers, neck, etc.

The instant disclosure can provide for several features which can maximize safety and durability of the bands and the device on which they are being used. For example, the band 100 can be designed to require lateral overextension to disengage the loop 104, 106 from the hook 402. This overextension can enhance safety of the exercise device 400, or other device, by preventing unintentional disconnection of the band from a respective hook 402. Further, the hooks 402 on the device can be staggered such that there will be no contact between two different bands 100 during operation. This lack of contact between the bands 100 can prevent friction damage to the bands, thus extending their life and diminishing the likelihood of sudden failure. Additionally, a third safety feature can be the addition of fins 410, 412 to the underside of the footplate 404 and on the crossbar 414, as seen in FIG. 9C. The close proximity of the fins 410, 412 to one another around the crossbar 414 and under the footplate 404 can prevent pinching of fingers between the two legs 408*a*, 408*b* while the device 400 is being set up. The fins can run substantially tangential to any rotation between the crossbar and the footplate to prevent a user's fingers, or other appendages, from being stuck or pinched by the legs.

Figure 10D:
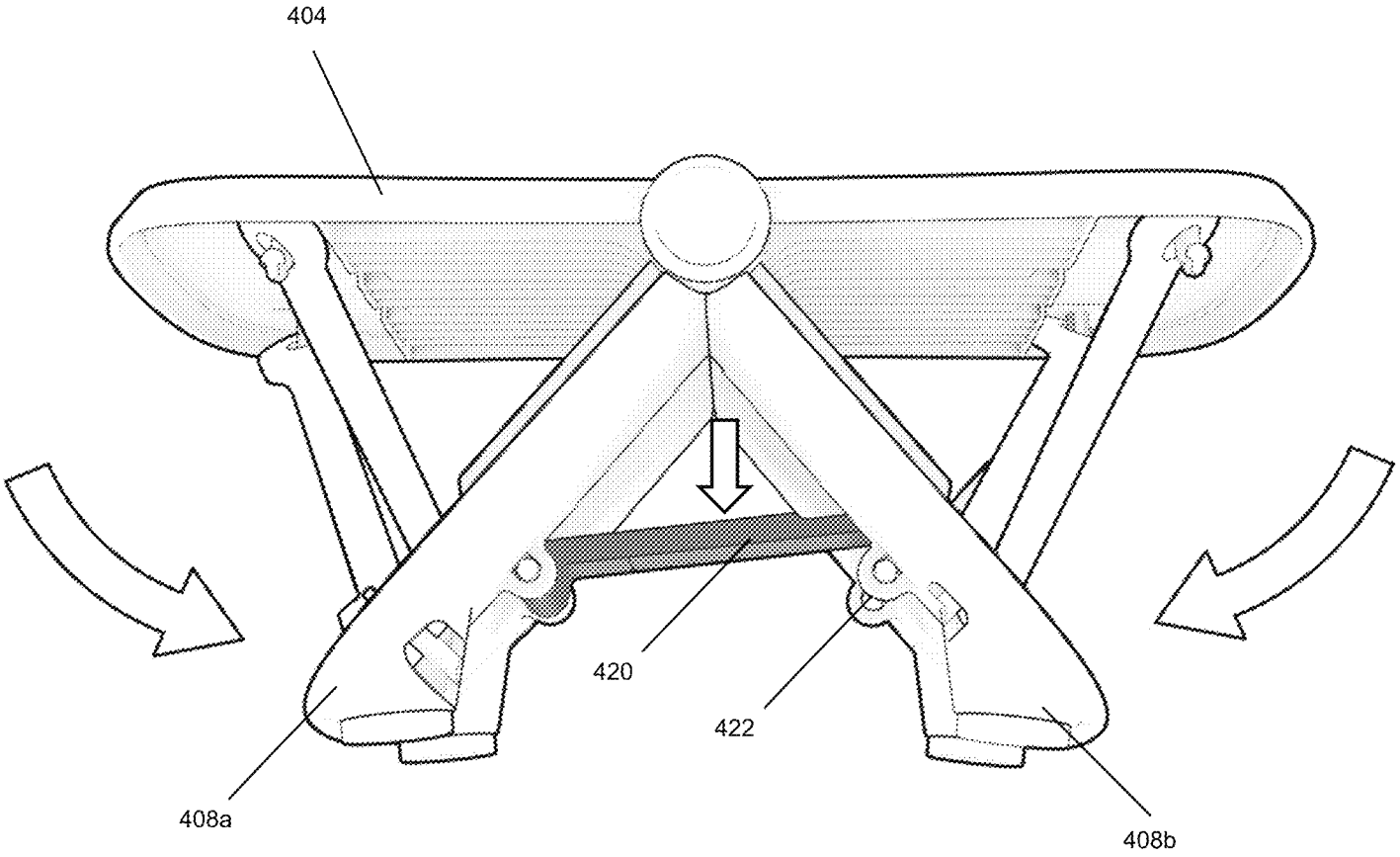

Further advantages of the instant system, or exercise device, 400 can relate to the ease of use of the instant resistance band system 300. For example, the hook 402 can be designed to smoothly and securely function with a variety of band sizes to allow the device to function with bands 100 that have a range of resistance levels and possibly a range of lengths, so that the device can be adapted to the size, strength, and range of motion of a user. In some embodiments, as shown in FIGS. 10A, 10B, 10C and 10D, the instant exercise device 400 can be provided with symmetrically arranged hooks. For example, in some embodiments, the system can include four hooks 402 disposed at the corners of a top surface of the legs 408*a*, 408*b* and four hooks 402 arranged on a bottom surface of the footplate 404. The hooks 402, in some embodiments, can be sized to add to the resistance of the exercise device 400. In some embodiments, as shown in FIGS. 10B, 10C, and 10D, the latch 420 that holds the device closed when not in use can be a gravity drop latch 420 that can be easily released by simultaneously squeezing at either end of the device, or pivoting the legs 408*a*, 408*b* in the directions of the arrows, shown in FIG. 10A, while the device 400 is inverted. As the legs 408*a*, 408*b*, are pivoted towards one another, the gravity drop latch 420 can disengage from a locking bar, or rod, 422 and can fall downward, as shown by the downward arrow. With the gravity drop latch 420 disengaged, the legs 408*a*, 408*b* can be pivoted towards the footplate 404, as seen in FIG. 10B. In some embodiments, the latch 420 can be disengaged from the locking bar 422 by inverting the device 400 such that the footplate 404 is below the legs 408*a*, 408*b*, as seen in FIG. 10A. In such an orientation, the distal ends of legs 408*a*, 408*b*, proximate the feet 416, can be pivoted towards one another, as shown by the arrows in FIG. to disengage the latch 420 from one of the legs 408*a*, 408*b*. The latch 420 can be designed such that only inward pivoting of the legs 408*a*, 408*b* can disengage the latch 420 in order to prevent unwanted collapse of the device 400. Once the latch 420 is disengaged, the legs 408*a*, 408*b* can pivot towards the footplate 404 and collapse for storage, as shown in FIG. 10B. To open the device 400, the legs 408*a*, 408*b* can pivot away from the footplate 404, towards one another, as seen in FIG. 10C. The legs 408*a*, 408*b* can be rotated towards each other, as seen in FIG. 10D, and the latch 420 can be re-engaged and locked against the locking bar 422, aided by gravity. For example, the latch 420 can be easily re-engaged to lock when the device 400 is upright and the ends are pressed together.

It will be appreciated by those skilled in the art that changes could be made to the embodiments described above without departing from the broad inventive concept thereof. It is to be understood, therefore, that this disclosure is not limited to the particular embodiments disclosed, but it is intended to cover modifications within the spirit and scope of the subject disclosure as disclosed above.

What is claimed is:

1. A resistance band comprising:

a barbell shaped band having a central body extending along a central length, the central body including at least one loop at an end of the barbell shaped band, the at least one loop imparted with a groove; and at least one bushing disposed within the at least one loop, the at least one bushing formed of a low friction material and including a reinforcement rib that extends radially outward from an outer surface of the at least one bushing, wherein the at least one loop is configured to stretch and/or deform relative to the at least one bushing, and wherein the reinforcement rib is seated securely within the groove to axially secure the at least one bushing within the at least one loop.

2. The resistance band of claim 1, wherein the barbell shaped band is a unitary structure.

3. The resistance band of claim 2, wherein the barbell shaped band is formed of thermoplastic elastomer.

4. The resistance band of claim 1, wherein the barbell shaped band includes at least two loops, respectively disposed at ends of the barbell shaped band.

5. The resistance band of claim 4, wherein:

the at least one bushing is at least two bushings: and each of the at least two bushings is disposed in a respective one of the at least two loops.

6. The resistance band of claim 1, wherein the at least one bushing is a substantially cylindrical shaped bushing.

7. The resistance band of claim 6, wherein the at least one bushing includes a through hole extending therethrough.

8. The resistance band of claim 1, wherein the at least one bushing is retained within the at least one loop without adhesives or chemical bonding.

9. The resistance band of claim 1, wherein the resistance band is manufactured via overmolding.

10. A bridle system comprising:

an upper platform including at least one upper hook extending from a first surface thereof;

a lower support structure pivotally connected to the upper platform, the lower support structure including at least one lower hook extending from a second surface thereof, wherein the first surface and the second surface face one another; and a resistance band, the resistance band including:

a central body extending along a central length, the central body including a first loop at a first end of the central body and a second loop at a second end of the central body, the first and second loops each including a respective groove; and a first bushing axially secured within the first loop and a second bushing axially secured within the second loop, the first bushing and the second bushing each includes a reinforcement rib that respectively extends radially outward from an outer surface of the first bushing and the second bushing, such that the respective reinforcement rib is seated within the respective groove, the first bushing and the second bushing formed of a low friction material;

wherein the first loop is disposed on the at least one upper hook and the second loop is disposed on the at least one lower hook, wherein the first loop is configured to stretch and/or deform relative to the first bushing, and wherein the second loop is configured to stretch and/or deform relative to the second bushing.

11. The bridle system of claim 10, wherein the central body is a barbell shaped band.

12. The bridle system of claim 11, wherein the barbell shaped band is a unitary structure.

13. The bridle system of claim 11, wherein the barbell shaped band is formed of thermoplastic elastomer.

14. The bridle system of claim 11, wherein the resistance band is a spring.

15. The bridle system of claim 10, wherein the first bushing and the second bushing are substantially cylindrical shaped bushings.

16. The bridle system of claim 10, wherein the first bushing is retained within the first loop without adhesives or chemical bonding, and the second bushing is retained within the second loop without adhesives or chemical bonding.

17. The bridle system of claim 10, wherein the resistance band is manufactured via overmolding.

18. The bridle system of claim 10, wherein the at least one upper hook and the at least one lower hook are formed of glass-filled nylon.

* * * * *